United States Patent [19]

Mitsuhashi

[11] 4,240,572

[45] Dec. 23, 1980

[54] COMBINED PUNCHING AND STAPLING DEVICE

[76] Inventor: Yoshio Mitsuhashi, 79, Higashi-Kibogaoka, Asahi-ku, Yokohama-shi, Kanagawa-ken, Japan

[21] Appl. No.: 15,354

[22] Filed: Feb. 26, 1979

[51] Int. Cl.[3] ..... B25C 5/02

[52] U.S. Cl. ..... 227/76; 83/597; 83/687

[58] Field of Search ..... 83/689, 589, 542, 597; 30/363, 358; 227/76

[56] References Cited

U.S. PATENT DOCUMENTS

| | | | |
|---|---|---|---|
| 1,574,159 | 2/1926 | Larkin | 83/689 X |
| 1,766,308 | 6/1930 | Rochat | 30/358 X |
| 1,936,783 | 11/1933 | Chase | 30/358 X |
| 2,558,567 | 6/1951 | Kaeser | 83/589 X |
| 3,130,885 | 4/1964 | Fleming | 83/689 X |
| 3,392,447 | 7/1968 | Hendricks et al. | 30/363 |
| 3,907,190 | 9/1975 | Mitsuhashi | 227/76 X |

FOREIGN PATENT DOCUMENTS

| | | | |
|---|---|---|---|
| 592179 | 4/1925 | France | 83/689 |
| 867548 | 4/1941 | France | 30/363 |
| 998373 | 7/1965 | United Kingdom | 83/589 |

*Primary Examiner*—J. M. Meister

*Attorney, Agent, or Firm*—Haseltine, Lake & Waters

[57] ABSTRACT

In a hand-operated punching device such as that incorporated with a stapler to enable the same both to staple and perforate sheets of paper or the like, an improved punch element is provided which is movable into and out of a hole in a die for perforation. The punch element has three or more sharp-edged cutting teeth formed peripherally on one end thereof in order to improve the perforating or cutting ability of the device. The axis of the pivot pin connecting the base, lever and staple magazine lies in a plane extending transversely to the longitudinal axis of the punch element intermediate between the distal end thereof and a location thereon to which the punch element is allowed to advance relative to the inlet of the hole. Numerous variations are possible in the structural details of the punch element.

13 Claims, 18 Drawing Figures

COMBINED PUNCHING AND STAPLING DEVICE

BACKGROUND OF THE INVENTION

This invention relates generally to devices for punching holes or like openings in paper, among other materials, and particularly to hand-operated punching devices or punches such as that incorporated with a portable stapler to provide an integrated device capable of both perforating and stapling operations. More particularly, this invention deals with a punch element of improved configuration for use in such hand-operated punching devices wherein the punch element is required to follow an arcuate path in moving into and out of mating engagement with a die.

A conventional punch element for hand-operated punching devices of the type under consideration has had its cutting or perforating end concaved so as to provide a pair of diametrically opposed, arcuate cutting teeth. These teeth have rounded crests and rounded roots. The punch element of this known configuration is the same as those used in the usual tabletop punching machines designed exclusively for perforating paper or the like.

With such tabletop punching machines the prior art punch elements are capable of properly piercing desired material, even extremely thin and pliant paper. This is because the punching machines permit precisely linear motion of the punch elements into and out of the die holes, affording a close running fit between punch elements and dies.

A problem occurs, however, when the prior art punch element finds its way into, for example, a punching device incorporated with a portable stapler. In the punch-stapler combination the punch element is carried by the staple magazine, and the corresponding die by the base, as disclosed for example in my U.S. Pat. No. 3,951,325. The staple magazine and the base are pin-jointed, each at one end, for pivotal motion toward and away from each other.

This construction of the punch-stapler combination compels the punch element to follow an arcuate path, centering at the pivot of the staple magazine, in its travel into and out of the hole in the die. The die hole must therefore receive the punch element with some clearance. If minimized by the critical positioning of the pivot, this clearance does not affect the ability of the punch-stapler combination to perforate usual letter paper or the like. Yet the device may be unable to properly perforate extremely thin paper or paper of some special texture.

SUMMARY OF THE INVENTION

It is a primary object of this invention to improve the cutting or perforating ability of punching devices of the type defined herein.

With this and other objects in view, this invention is directed, in brief, to the provision of a hand-operated punching device for perforating paper or the like, which comprises two coacting members pivotally joined for exertion of a force therebetween by leverage, a die on one of the coacting members, and a punch element carried by the other of the coacting members for relative movement into and out of mating engagement with the die. The punch element has at least three sharp-edged cutting teeth formed peripherally on one of its ends.

The improved punch element with its three or more cutting teeth, in contrast to two such teeth of the prior art element, permits a wide range of variations in its structural details, as will be understood upon consideration of the several preferred embodiments disclosed herein. The use of such various forms of the improved punch element results in marked improvement in the perforating or cutting ability of punching devices of the type in question, even with extremely thin and pliant paper. This is particularly so when the clearance between the punch element and the die is minimized through careful positioning of the pivot between the two coacting members. The punching devices to which the punch element of this invention is applicable include, for example, those of the punch-stapler combination type, the pliers type, and the hinge type.

The above and other objects, features and advantages of this invention and the manner of attaining them will become more clearly apparent, and the invention itself will best be understood, from the following detailed description and appended claims, with reference had to the accompanying drawings.

BRIEF DESCRIPTION OF THE DRAWINGS

In the drawings:

FIG. 1 is a perspective view of a prior art punch element that has been used in hand-operated devices for perforating paper or the like;

DETAILED DESCRIPTION

Figure 1:
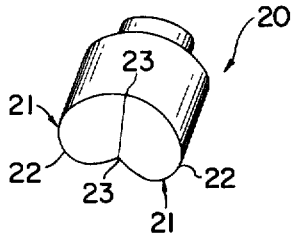
FIG. 1 PRIOR ART
Figure 2:
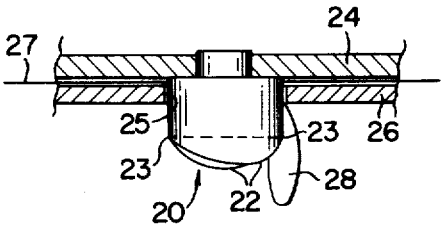
FIG. 2 PRIOR ART
FIG. 2 shows, partly in side elevation and partly in section, the prior art punch element of FIG. 1 as incorporated in a hand-operated punching device, the figure being explanatory of how the prior art punch element forms an incomplete punching in such a device.

A brief inspection of FIGS. 1 and 2 will make clearer the noted preblem of the conventional punch element used in punching devices of the type pertinent to this invention. As better seen in FIG. 1, the prior art punch element 20 has one of its ends formed into a pair of diametrically opposed, generally arcuate cutting teeth 21. Both crests 22 and roots 23 of these cutting teeth are rounded.

FIG. 2 shows the prior art punch element 20 as mounted under the staple magazine 24 of a known punch-stapler combination. The punch element 20 has just been depressed into a hole 25 in a die 26 to punch a hole in paper 27, which in this instance is assumed to be thin and pliant. Owing to the required clearance between punch element 20 and die 26 the punch element has failed to completely cut the punching 28 off the rest of the paper 27. This failure has occurred through the following procedure.

Upon depression of the staple magazine 24 the two crests 22 of the cutting teeth 21 on the punch element 20 first incise the paper 27. Then one of the two roots 23 of the punch element teeth 21 which is located closer to the pivot of the staple magazine 24 subsequently cuts into the paper 27. By the time the other root of the punch element teeth 21 cuts into the paper 27, however, the incomplete punching 28 turns down from the rest of the paper and is thus left connected thereto even though the punch element 20 subsequently moves down to the illustrated lowermost position within the die hole 25. Then the punch element 20 returns to the initial position, leaving the incomplete punching 28 in its depending disposition.

The improved punch element of this invention thoroughly overcomes this problem of incomplete perforation encountered in the prior art. The invention will now be described in terms of its first preferred embodiment shown in FIGS. 3, 4 and 5.

Generally designated 30, the example of the punch element of this invention is of generally cylindrical shape. The punch element 30 has a boss 31 formed coaxially on one end thereof for use in mounting the punch element in position on a desired punching device. The other end of the punch element 30 is formed into four sharp-edged, peripheral cutting teeth 32 arranged at constant circumferential spacing. The cutting teeth 32 have pointed crests 33, pointed roots 34 and, as seen in a side view as in FIG. 4, straight side edges 35.

Figure 4:
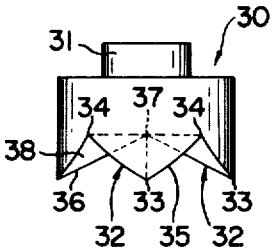
FIG. 4 is a side elevational view of the punch element of FIG. 3.

As best seen in FIG. 4, a straight ridge 36 extends radially between the pointed crest 33 of each cutting tooth 32 and the center 37 of the punch element 30 at said other end thereof. This center 37 at said other end of the punch element 30 is located some distance toward said one end thereof from the plane containing the pointed crests 33 of the cutting teeth 32, so that the straight radial ridges 36 slope correspondingly. Each radial ridge 36 is flanked on both sides with a pair of flat, sloping surfaces 38 of sectorial shape. Bounding each of these sectorial surfaces 38 are one of the cutting tooth side edges 35, one of the radial ridges 36, and one of the radial lines 39 extending between the cutting tooth roots 34 and the center 37.

Figure 5:
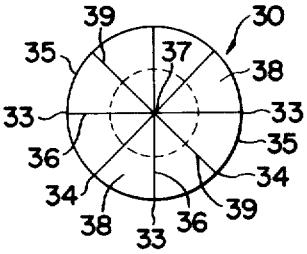
FIG. 5 is a bottom plan view of the punch element of FIGS. 3 and 4.
Figure 6:
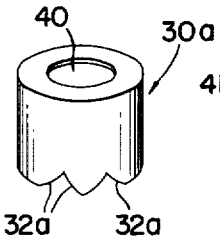
FIG. 6 is a perspective view of another preferred form of the punch element in accordance with this invention.

FIG. 6 illustrates a modified punch element 30*a* having a suitably great number of peripheral cutting teeth 32*a*, instead of four such teeth 32 of the preceding embodiment of the invention, formed on one end thereof at constant circumferential spacing. The punch element 30*a* also features, incidentally, a mounting socket 40 formed in the other end thereof in place of the mounting boss 31 of the preceding embodiment. The other details of construction can be exactly as set forth above in connection with FIGS. 3, 4 and 5.

Figure 7:
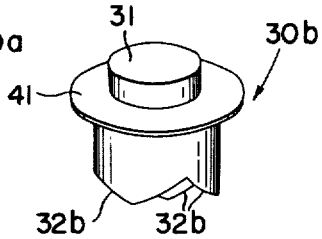
FIG. 7 is a perspective view of still another preferred form of the punch element in accordance with this invention.

FIG. 7 illustrates another modified punch element 30*b* which has three cutting teeth 32*b* formed peripherally on one end thereof at constant circumferential spacing. Formed on the other end of this punch element 30*b* is a mounting flange 41, in addition to the mounting boss 31, although the latter may be unnecessary in some instances. The other details of construction can also be identical to those of the embodiment of the invention shown in FIGS. 3, 4 and 5.

The three cutting teeth 32*b* on the punch element 30*b* represents the minimum number of such teeth to be formed on the improved punch element of this invention. Thus the punch element 30*b* embodies this invention in its simplest form. It will be understood that the mounting means 31, 40 and 41 on the above three punch elements 30, 30*a* and 30*b* are interchangeable. For example, the mounting boss 31 may be formed on the punch element 30*a*, or the mounting flange 41 on the punch element 30.

Figure 8:
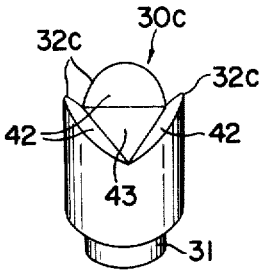
FIG. 8 is a perspective view of a further preferred form of the punch element in accordance with this invention.

Still another modified punch element 30*c* shown in FIG. 8 also has three sharp-edged cutting teeth 32*c* formed peripherally at constant angular spacing on the distal end thereof. Although akin to the punch element 30*b* of FIG. 7 in the number of teeth, this punch element 30*c* has the cutting edge of its teeth 32*c* curved arcuately as seen in a side view. Each cutting tooth 32*c* has a flat, relatively steeply sloping inside surface 42. These inside surfaces of all the cutting teeth 32*c* are joined directly to a recessed, flat surface 43 of triangular shape oriented perpendicular to the axis of the punch element 30*c*. The mounting boss 31 is disposed on the proximal end of this punch element 30*c*.

As will be readily understood from the foregoing, the punch element 30*c* of FIG. 8 can be further modified to have four or more such curved cutting teeth 32*c*. The three teeth shown in FIG. 8 are by way of example only.

Figure 9:
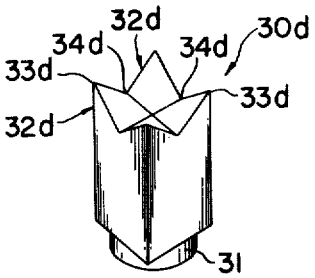
FIG. 9 is a perspective view of a still further preferred form of the punch element in accordance with this invention.

FIG. 9 illustrates a further modified punch element 30*d*, differing from all of the preceding examples in being square in cross sectional shape. This punch element 30*d* is, of course, intended for use in punching square openings in paper or the like. One end of the punch element 30*d* is formed into four sharp-edged cutting teeth 32*d* having pointed crests 33*d* and pointed roots 34*d*. The crest 33*d* of each cutting tooth 32*d* is located at one of the angles of the square. The other end of the punch element 30*d* has the mounting boss 31.

The square cross sectional shape of the punch element 30*d* is also purely by way of example. The principles of FIG. 9 apply to punch elements of any desired polygonal cross sectional shape.

Figure 3:
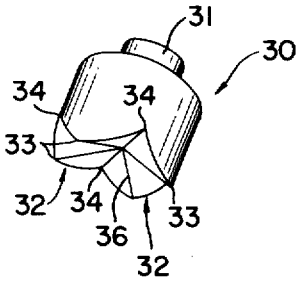
FIG. 3 is a perspective view of a preferred form of the improved punch element in accordance with this invention.
Figure 10:
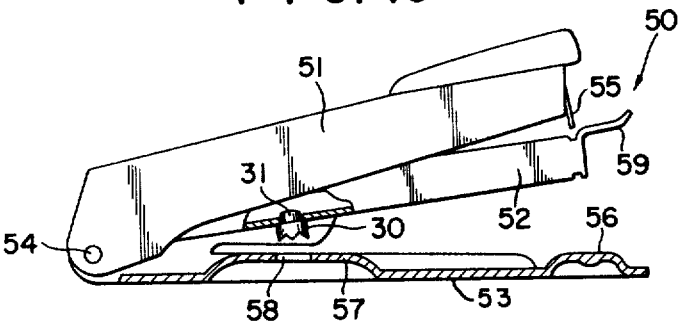
FIG. 10 is a side elevational view, partly broken away and partly sectioned, of a punch-stapler combination incorporating the punch element of FIGS. 3, 4 and 5.

In FIG. 10 the punch element 30 of FIGS. 3, 4 and 5 is shown incorporated in a punch-stapler combination 50 by way of illustration of one possible application of the punch element. Of the type disclosed in my U.S. Pat. No. 3,951,325, the punch-stapler combination 50 comprises a lever 51, a staple magazine 52, and a base 53, all pivotally pinned together at 54. The lever 51 has a hammer 55 secured thereto and depending therefrom for ejecting successive staples (not shown) from within the staple magazine 52 and for forcing the staples against an anvil 56 on the base 53. Clinched by the anvil 56, the ejected staples bind desired papers together. Reference is directed to my U.S. Pat. No. 3,951,325, as aforesaid, for greater details in the construction and operation of this punch-stapler combination 50.

The improved punch element 30 of this invention is mounted under the staple magazine 52, in a position intermediate its ends, by having the mounting boss 31 pressfitted in a bore formed in the bottom of the staple magazine. For mating engagement with the punch element 30 a die 57 having a through hole 58 is formed integral with the base 53.

Figure 11:
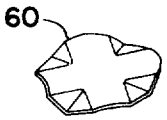
FIG. 11 is an enlarged perspective view of a punching formed by the punch-stapler combination of FIG. 10.

In the use of the punch-stapler combination 50 as a punch, paper may be placed between punch element 30 and die 57. The staple magazine 52 may then be depressed, by exertion of finger pressure on a thumbpiece 59 formed integral therewith. The crests 33 of the four cutting teeth 32 on the descending punch element 30 first cut into the paper. The perforating operation proceeds until, finally, the roots 34 of the cutting teeth 32 sever the punching from the rest of the paper. FIG. 11 shows the punching 60 thus severed.

By the time the roots 34 of the cutting teeth 32 sever the punching 60 from the rest of the paper, their crests 33 have all cut into the paper, causing deformation of the partial punching into the approximate shape of FIG. 11. Consequently, even though one of the four roots 34 of the cutting teeth 32 may then cut into the paper earlier than the other roots, this does not result in the turning down of the incomplete punching as in the prior art case of FIG. 2. Thus the punch element 30 properly perforates the paper, no matter how thin and pliant it may be.

The above description of the process of perforation by the punch element 30 essentially holds true with all the other punch elements 30*a*, 30*b*, 30*c* and 30*d* disclosed herein. Advantageously, the cutting teeth of these punch elements according to this invention are easier to cut into paper or other material than those of the prior art, requiring less force for perforation.

Figure 12:
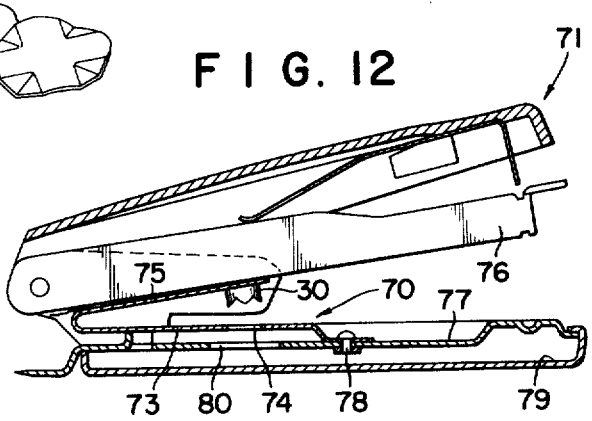
FIG. 12 is a side view, partly in longitudinal section, of another example of punch-stapler combination incorporating the punch element of FIGS. 3, 4 and 5.
Figure 13:
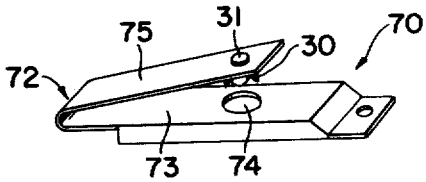
FIG. 13 is a perspective view of a punching assembly in the punch-stapler combination of FIG. 12.

FIGS. 12 and 13 represent another possible application of this invention, in which the punch element 30 of FIGS. 3, 4 and 5 is used in a punching assembly 70 incorporated with a stapler 71. The stapler itself is largely identical with the stapler proper of the punch-stapler combination 50 of FIG. 10, so that its description will be omitted.

The punching assembly 70 includes a strip 72 of resilient sheet metal bent into the shape of a U to provide two opposed arms. One of the arms of the U-shaped resilient strip 72 is formed into a die 73 having a through hole 74 formed therein. The other arm 75 serves as a carrier for the punch element 30, which has its mounting boss 31 pressfitted in a bore formed in the carrier arm 75. Mounted between staple magazine 76 and base 77 of the stapler 77, the punching assembly 70 is screwed at 78 to the base 77. This base is shown to have a chamber 79 for the reception and storage of punchings, which will fall therein through an opening 80 formed immediately under the die hole 74.

As in the punch-stapler combination 50 of FIG. 10, the depression of the staple magazine 76 results in the perforation, by the punching assembly 70, of the paper held between the two arms of the punching assembly. It is therefore self-evident that the improved punch element 30 of this invention functions in the above described manner to positively perforate the paper. The punching assembly 70 serves the additional purpose of springing the punch element 30 and the staple magazine 76 back to their normal positions upon release of the manual pressure on the staple magazine.

Figure 14:
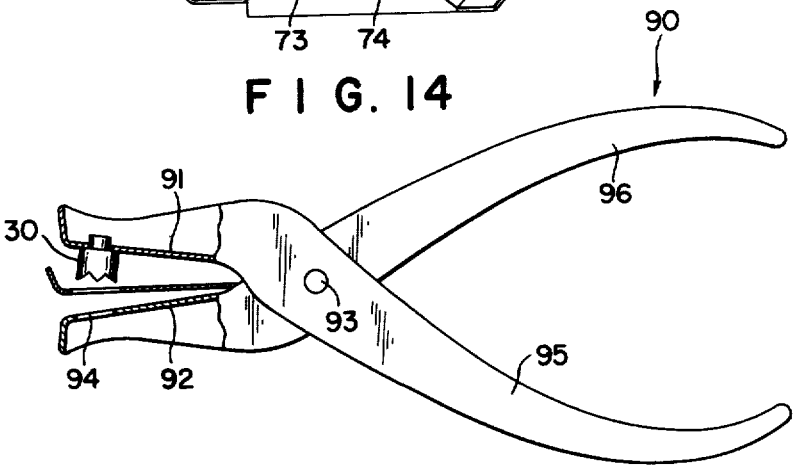
FIG. 14 is a side view, partly in section, of a pliers-type punching device incorporating the punch element of FIGS. 3, 4 and 5.

FIG. 14 shows the punch element 30 as applied to a Pliers-type punching device 90 having a pair of opposed jaws 91 and 92 movable toward and away from each other on a pivot 93. The upper jaw 91 carries the punch element 30, whereas the lower jaw 92 has a die hole 94 formed therein for receiving the punch element. The jaws 91 and 92 have integral handles 95 and 96, respectively. By squeezing these handles 95 and 96 toward each other against the force of a return spring (not shown), the punch element 30 can be forced into the die hole 94 for positively punching paper or the like in the manner apparent from the foregoing.

Figure 15:
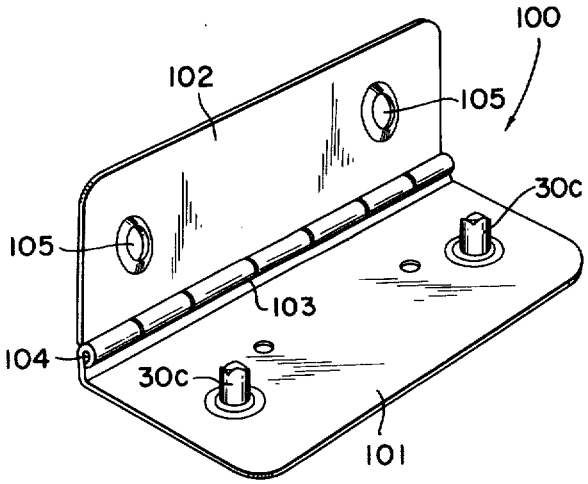
FIG. 15 is a perspective view of a hinge-type punching and filing device incorporating a pair of punch elements of the type shown in FIG. 8.

In FIG. 15 a pair of punch elements 30*c* of the type pictured in FIG. 8 are shown applied to a hinge-type punching and filling device 100. Usually this punching device is to be incorporated in or with a folder, rule assembly, pencil case, or other articles. The punching device 100 comprises a pair of flaps 101 and 102 pivotally joined through their interfitting knuckles 103 by a pin 104. The flap 101 has the pair of punch elements 30*c* mounted uprightly thereon with a desired spacing therebetween. The other flap 102 has a pair of die holes 105 formed therein for mating engagement with the respective punch elements 30*c*.

Figure 16:
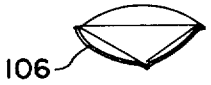
FIG. 16 is an enlarged perspective view of a punching formed for example by the hinge-type punching and filing device of FIG. 15.

Upon pivotal motion of the flap 102, for example, toward the other flap 101, two holes are simultaneously punched in paper or the like held between the two flaps. FIG. 16 illustrates one of the punchings 106 thus severed from the rest of the paper. The punch elements 30*c*, each with the three curved cutting teeth 32*c*, also form no such incomplete punchings as that depicted in FIG. 2, largely for the same reasons as those set forth in conjunction with the punch element 30 of FIGS. 3, 4 and 5.

In order to derive the utmost perforating ability from the various punching devices incorporating the improved punch element of this invention, as disclosed herein, the unavoidable clearance between the punch element and the die (when the former is travelling into and out of the hole in the latter along the arcuate path) should be minimized. The attainment of this objective calls for the critical positioning of the pivot joining the two coacting members (e.g., the staple magazine and the base in the case of a punch-stapler combination) carrying the punch element and the die.

Figure 17:
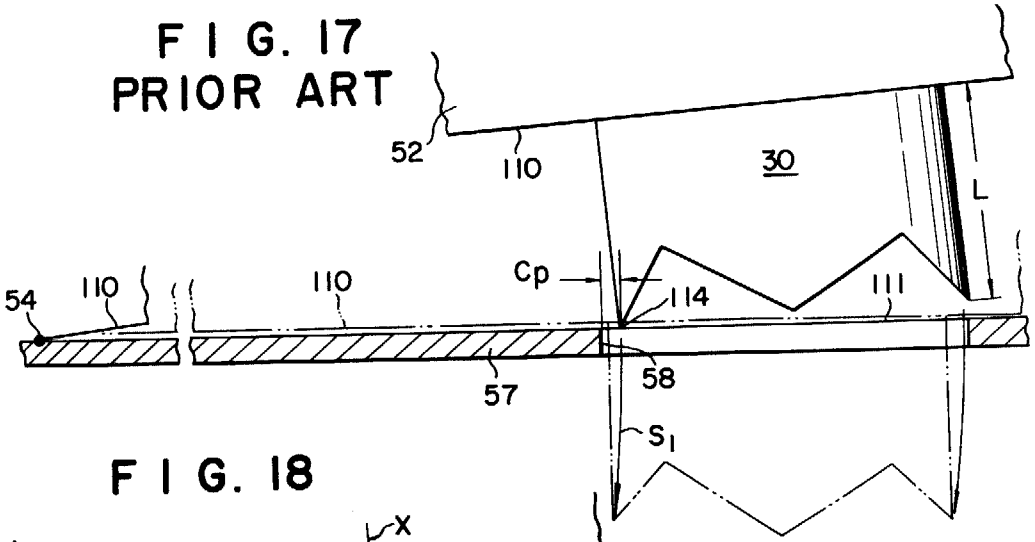
FIG. 17 PRIOR ART
FIG. 17 is a schematic, fragmentary view, partly in elevation and partly in section, showing the location of the pivot between the staple magazine and base of a prior art punch-stapler combination.

In the known punch-stapler combination schematically illustrated in FIG. 17, the pivot 54 for the magazine 52 and the die 57 lies in the planes of the bottom, surface 110 of the magazine 52 and the upper surface 111 of the die 57, so that the pivot 54 is at the intersection of the planes of the surfaces 110 and 111, and, when the punch element 30 advances to its lowermost or most advanced position indicated by chain line, the bottom surface 110 of the magazine 52 is brought into face-to-face contact with the upper surface 111 of the die 57. It will be understood that the forward cutting edge 114 of the punch element 30 must move from its solid line position at which it is about to enter die hole 58 to its most advanced chain line position along a relatively long arc $S_1$ substantially corresponding to the axial length L of the punch element 30. It will be seen that the forward cutting edge of the punch element 30 undergoes displacement to the left relative to the die hole 58 while it advances along the arc $S_1$, so that a clearance $C_p$, which must be at least equal to the amount of the leftward displacement of the forward cutting edge, must exist in the instant when the forward cutting edge 114 is about to enter the die hole 58.

Since the arc $S_1$ is relatively long, being substantially equal to the axial length L of the punch element 30 as mentioned hereinbefore, and therefore the amount of the leftward displacement is also relatively great, the clearance $C_p$ must necessarily be relatively great. Because of this relatively great clearance $C_p$, the known device is not capable of performing effective punching or perforating operation.

Figure 18:
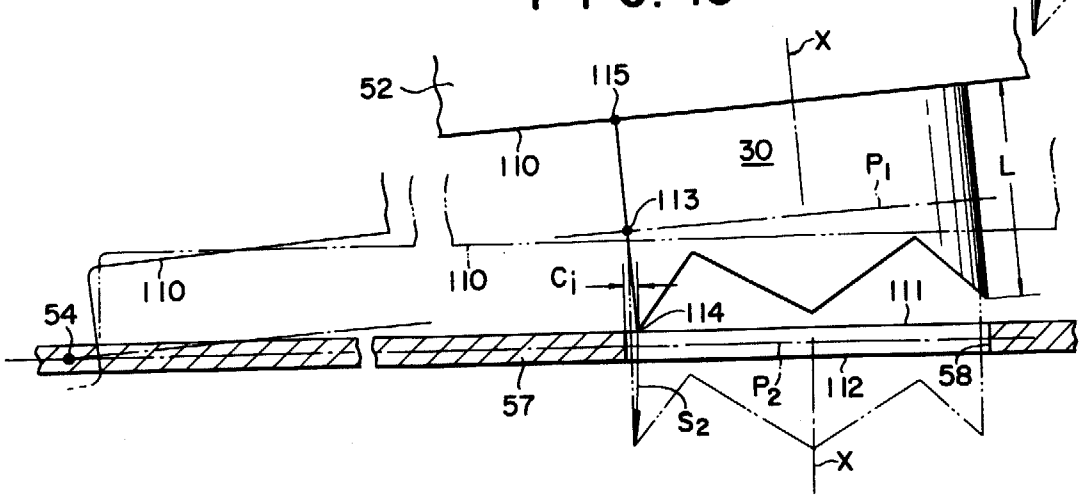
FIG. 18 is a view similar to FIG. 17 but showing the improved location of the pivot between the staple magazine and base.

FIG. 18 shows an improved disposition of the pivot 54. According to the improvement, the pivot 54 lies in a plane $P_1$ extending transversely to the longitudinal axis X of the punch element 30 at a position 113 thereon intermediate between the forward cutting edge 114 or distal end thereof and a location 115 thereon to which the punch element 30 can advance relative to the inlet of the die hole 58. The above stated location 115 on the punch element 30 is, in the example shown in FIG. 18, the proximal end of the element 30 at which it is secured to the bottom surface 110 of the magazine 52.

The pivot 54 preferably lies in a plane $P_2$ parallel to and between the planes of the upper and lower surfaces 111 and 112 of the die 57.

According to the above arrangement, it is only necessary for the forward cutting edge 114 of the punch element 30 to move along a relatively short arc $S_2$ substantially equal to half the axial distance L between the forward cutting edge 114 and the location 115, after the cutting edge 114 has entered the inlet of the die hole 58. This means that the clearance $C_i$, which must exist in the instant when the forward cutting edge 114 is about to enter the die hole 58, can be made relatively small. It will be understood that when the punch element 30 advances to a position at which the planes $P_1$ and $P_2$ coincide with each other, the clearance between the outer surface of the punch element 30 and the inner surface of the die hole 58 will become the minimum, and, when the punch element 30 advances further to a position at which the location 115 is at the inlet of the die hole 58, the clearance will increase to a value equal to $C_i$. Accordingly, the maximum value of the clearance is $C_i$ which is substantially half the maximum clearance $C_p$ in the known device. For this reason, more effective punching performance can be obtained according to the above improvement.

Although the location 115 to which the punch element 30 can enter the die hole 58 is shown in FIG. 18 as the location of the proximal end of the element 30, the location 115 need not be the proximal end.

It has been found that this improved arrangement of the pivot 54 permits the reduction of the clearance to no more than 0.05 millimeter in a standard-size punch-stapler combination. The punch element of this invention, combined with the thus reduced clearance between it and the die will materially enhance the perforating ability of the punching devices of the type in question.

What I claim is:

1. A combined punching and stapling device comprising: a base having an anvil on its distal end; a lever pivotally secured at its proximal end by means of a pivot pin to the proximal end of the base; a staple magazine pivotally secured at its proximal end by means of said pivot pin so as to be swingable about the pivot pin relative to the lever; a hammer fixed at the distal end of the lever so as to be movable into and through the magazine for ejecting successive staples from within the magazine and for forcing the staples against the anvil for stapling operation; a die provided on the base; a punch element fixedly mounted on the staple magazine for relative movement into and out of mating engagement with the die as the magazine and the base are pivoted toward and away from each other; and at least three sharp-edged cutting teeth formed peripherally on the distal end of the punch element, said die being in the form of a flat plate having formed therein a hole for receiving the punch element, the axis of said pivot pin lying in a plane extending transversely to the longitudinal axis of the punch element at a position thereon intermediate between the distal end thereof and a location thereon to which the punch element is allowed to advance relative to the inlet of the hole.

2. The device according to claim 1, wherein the cutting teeth of the punch element have pointed crests and pointed roots.

3. The device according to claim 2, wherein each cutting tooth of the punch element has straight side edges as seen in a side view.

4. The device according to claim 2 or 3, wherein a straight ridge extends between the crest of each cutting tooth and the center of the punch element at said distal end thereof, each ridge being flanked with a pair of flat, sloping surfaces of sectorial shape.

5. The device according to claim 1, wherein each cutting tooth of the punch element has a curved cutting edge as seen in a side view.

6. The device according to claim 5, wherein each cutting tooth of the punch element has a flat, sloping inside surface.

7. The device according to claim 6, wherein the inside surfaces of the cutting teeth are joined directly to a flat surface of polygonal shape oriented perpendicular to the axis of the punch element.

8. The device according to claim 1, 2, 3, 5, 6 or 7, wherein the punch element is generally cylindrical in shape.

9. The device according to claim 2 or 3, wherein the punch element is polygonal in cross sectional shape, and wherein the crest of each cutting tooth is located at one of the angles of the polygon.

10. The device according to claim 1, 2, 3, 5, 6 or 7, wherein the punch element has mounting means formed on the other end thereof.

11. The device according to claim 10, wherein the mounting means is in the form of a boss.

12. The device according to claim 10, wherein the mounting means is in the form of a socket.

13. The device according to claim 10, wherein the mounting means comprises a flange.

* * * * *